US012759035B1

(12) United States Patent
Jordan et al.

(10) Patent No.: US 12,759,035 B1
(45) Date of Patent: Oct. 13, 2026

(54) ROTATIONAL INDEXING SYSTEM FOR USE WITH A CONDUIT BENDING APPARATUS

(71) Applicants: David S. Jordan, Clinton, TN (US); Michael C. Jordan, Heiskell, TN (US); Scott M. Jordan, Powell, TN (US)

(72) Inventors: David S. Jordan, Clinton, TN (US); Michael C. Jordan, Heiskell, TN (US); Scott M. Jordan, Powell, TN (US)

(73) Assignee: iTool Equipment Holding LLC, Clinton, TN (US)

( * ) Notice: Subject to any disclaimer, the term of this patent is extended or adjusted under 35 U.S.C. 154(b) by 200 days.

(21) Appl. No.: 18/436,680

(22) Filed: Feb. 8, 2024

(51) Int. Cl.
*B21D 7/16* (2006.01)
*B21D 7/024* (2006.01)

(52) U.S. Cl.
CPC ..... *B21D 7/16* (2013.01); *B21D 7/024* (2013.01)

(58) Field of Classification Search
CPC ..... B21D 7/16; B21D 7/024; B21D 7/025
See application file for complete search history.

(56) References Cited

U.S. PATENT DOCUMENTS

| | | | | |
|---|---|---|---|---|
| 1,424,366 | A | 8/1922 | Mcardle | |
| 1,462,673 | A | 7/1923 | Wheeler | |
| 4,025,749 | A | 5/1977 | Spurr | |
| 4,546,632 | A | 10/1985 | Van Den Kieboom | |
| 4,870,849 | A | 10/1989 | Traub | |
| 5,187,963 | A | 2/1993 | Sutton, Jr. | |
| 5,226,305 | A | 7/1993 | Adleman | |
| 5,284,041 | A | 2/1994 | Christensen | |
| 5,337,590 | A | 8/1994 | Schuchert | |
| 11,400,503 | B2 | 8/2022 | Plummer et al. | |
| 12,551,940 | B1 | 2/2026 | Jordan et al. | |
| 2006/0277968 | A1 | 12/2006 | Mirtz | |
| 2010/0223971 | A1 | 9/2010 | Jaubert | |
| 2016/0354822 | A1 | 12/2016 | Nozu | |
| 2017/0291206 | A1 | 10/2017 | Elder | |
| 2023/0001465 | A1 * | 1/2023 | Gambino | B21D 7/06 |

FOREIGN PATENT DOCUMENTS

| | | |
|---|---|---|
| CN | 112893549 | 6/2021 |
| EP | 1561522 | 8/2005 |
| SU | 1593731 | 9/1990 |

* cited by examiner

*Primary Examiner* — Debra M Sullivan
(74) *Attorney, Agent, or Firm* — Trenner Law Firm, LLC; Mark Trenner

(57) ABSTRACT

A system for rotatably indexing a conduit to be bent with a conduit bending apparatus utilizes a guide track, a carriage which is mounted upon the guide track for movement toward and away from the bending apparatus, and a support plate supported by the carriage for movement therewith along the guide track. The support plate has a face which is arranged substantially normal to the permitted direction of movement of the carriage along the guide track, and a hub member having a body is mounted upon the support plate for rotation relative thereto about an axis of rotation which is oriented substantially normal to the face thereof. By securing the distal end of the conduit to the hub member and rotatably indexing the hub member about its rotation axis through a desired number of angular degrees, the conduit is rotatably indexed about its longitudinal axis by a corresponding amount.

16 Claims, 11 Drawing Sheets

ROTATIONAL INDEXING SYSTEM FOR USE WITH A CONDUIT BENDING APPARATUS

BACKGROUND OF THE INVENTION

This invention relates generally to means and methods for forming a bend in a straight conduit of cylindrical shape and relates, more particularly, to accessories for use with such an apparatus.

The class of conduit bending apparatus with which this invention is concerned utilizes a conduit bending shoe having an outer periphery which is arcuate in shape and which is mounted upon a frame for rotation about an axis. Commonly, the arcuate-shaped periphery of the shoe defines at least one outwardly-opening groove which is U-shaped in cross section and whose opening is adapted to accept a portion of the outer surface of the conduit desired to be bent. By positioning the shoe in engagement with the conduit so that the conduit is accepted by the outwardly-opening groove and then pressing the shoe against the conduit while simultaneously rotating the shoe about its rotation axis so that the outer periphery of the shoe moves in rolling engagement along the length of the conduit, a bend is formed in the conduit whose curvature substantially corresponds to the curvature of the shoe periphery and wherein the bend, when formed, lies substantially in a plane.

An example of a conduit bending apparatus of the aforedescribed class is shown and described in U.S. Pat. No. 11,400,503, the disclosure of which is incorporated herein by reference.

Occasionally, it is desirable to form a plurality of bends in sequence along the length of a straight conduit wherein the plane in which a second, or subsequent, bend is formed along the conduit is disposed in an angular relationship with the plane in which an earlier, or first, bend along the conduit is formed. In other words and in this example, the planes in which two successive bends are desired to be formed along the length of a conduit are not coplanar.

Heretofore and when utilizing a conduit bending apparatus of the aforedescribed class to form a bend along the length of the conduit after which a first bend is formed therein, the conduit is first removed, or disengaged, from the outwardly-opening groove of the shoe, and the conduit is moved relative to (e.g. pulled along beneath) the shoe to advance the conduit to a position beneath the shoe at which the second bend is desired to be formed. However, in order for the plane of the subsequent bend to be formed and angularly offset to the plane of the first-formed bend, the conduit is rotated about its longitudinal axis by the desired angle of offset. For example, if the plane containing a subsequently-formed bend is desired to be offset to the plane containing the first-formed bend by forty-five degrees, an operator would be required to manually rotate, or index, the conduit about its longitudinal axis through forty-five degrees (from an original, or reference, orientation) before the shoe is once again moved into engagement with the conduit to commence the formation of the next, or subsequent, bend along the length of the conduit. Heretofore, there has been no means by which a conduit is readily or accurately indexed about its longitudinal axis in preparation of the formation of a second, or subsequent bend along the length of the conduit. Instead and more likely than not, an operator manually rotated the conduit by an amount which he thought was the desired number of angular degrees. Of course, such a method often involved guesswork and was not particularly accurate.

It would be desirable to provide a new and improved scheme for use with a conduit bending apparatus of the aforedescribed class which facilitates the rotational indexing of a conduit about its longitudinal axis through a desired number of angular degrees prior to a bending operation performed upon the conduit.

Accordingly, it is an object of the present invention to provide a new and improved scheme for use with a conduit bending apparatus of the aforedescribed class which facilitates the rotational indexing of a conduit about its longitudinal axis through a desired number of angular degrees.

Another object of the present invention is to provide such a scheme, or system, which enables the conduit to be readily indexed about its longitudinal axis with accuracy and without the need for guesswork.

Another object of the present invention is to provide a system which is particularly well-suited for use when forming a sequence of bends along the length of a conduit wherein the planes in which the bends are formed are angularly offset from one another.

Still another object of the present invention is to provide such a system which facilitates the set-up of the orientation of a conduit relative to the shoe in preparation of a conduit bending operation performed with a conduit bending operation of the aforedescribed class.

Still another object of the present invention is to provide such a system which is uncomplicated in structure, yet effective in operation.

SUMMARY OF THE INVENTION

This invention resides in an improvement to a conduit bending apparatus wherein the apparatus includes a conduit indexing system having a conduit-bending shoe mounted for rotation about a first axis. The conduit desired to be bent has a longitudinal axis, a proximal end which is capable of being engaged by the conduit-bending shoe for conduit-bending purposes and a distal end which extends away from the shoe. The conduit indexing system includes a guide track having a length and which extends lengthways away from the shoe of the conduit bending apparatus. A carriage can be mounted upon the guide track for movement relative thereto and along the length thereof toward and away from the shoe. A support plate is supported by the carriage for movement therewith along the length of the guide track. The support plate has a face which is oriented in a plane which is arranged substantially normal to the permitted direction of movement of the carriage along the guide track. A hub assembly having a body is mounted upon the support plate for rotation relative thereto about a second axis of rotation which is oriented substantially normal to the plane of the face thereof. The body is sized to accept the distal end of the conduit desired to be bent when the distal end of the conduit is directed endwise thereabout. Means is provided for securing the distal end of the conduit about the body of the hub assembly. By securing the distal end of the conduit about the body of the hub assembly, and then rotatably indexing the body of the hub assembly about the second axis of rotation and relative to the face of the support plate through a desired number of angular degrees, the conduit is rotatably indexed about its longitudinal axis by a corresponding number of angular degrees.

DETAILED DESCRIPTION OF THE ILLUSTRATIVE EMBODIMENTS

Figure 1:
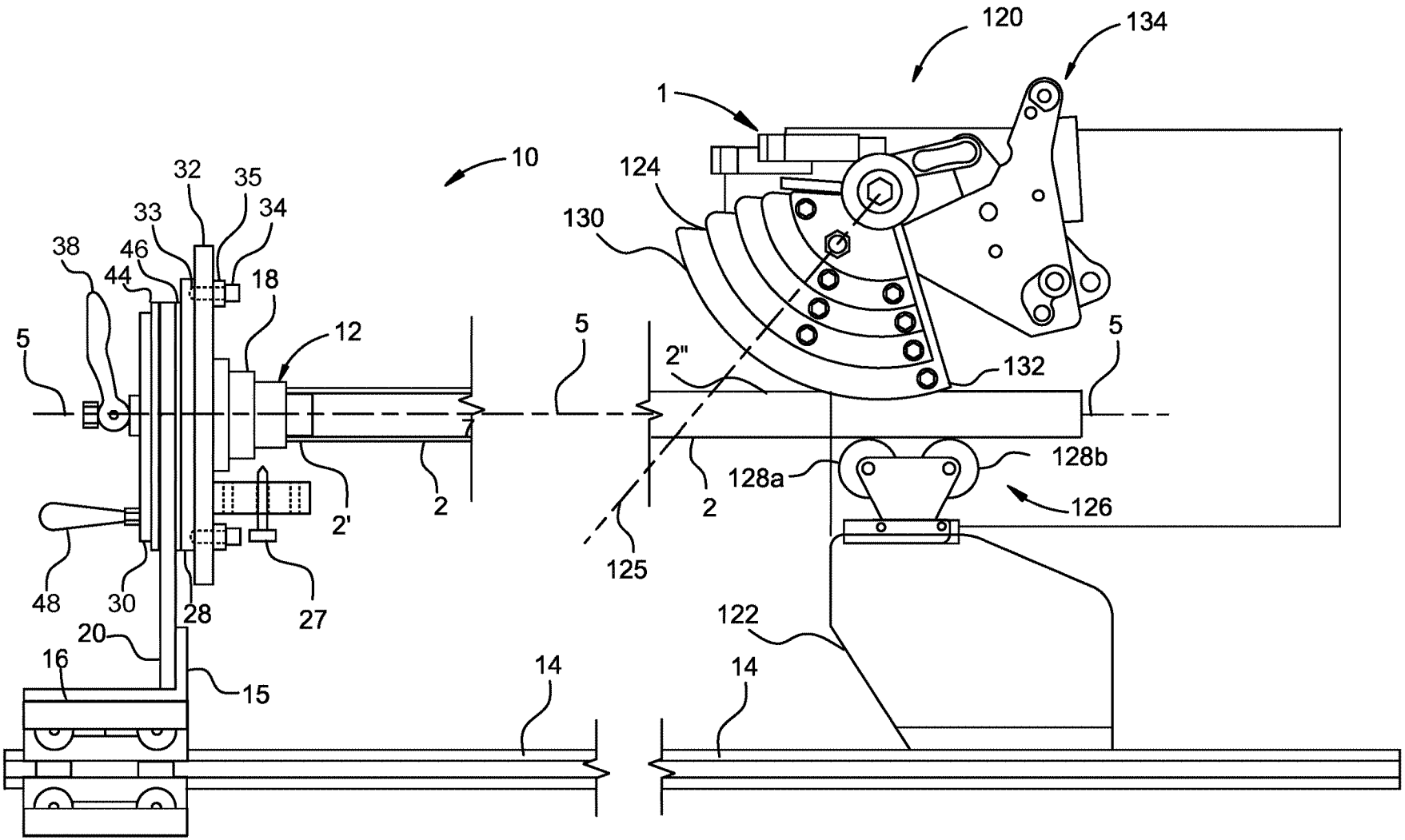
FIG. 1 is a side elevation view of a conduit bending apparatus and rotational indexing system with which features of the present invention are incorporated.

Turning now to the drawings in greater detail and considering first FIG. 1, there is schematically illustrated a rotational indexing system, generally indicated 10, within which features of the present invention are incorporated for rotatably indexing an elongated conduit 2 about its rotational axis 5 and through a desired number of angular degrees prior to a bending operation being performed upon the conduit 2 with a power bending apparatus, generally indicated 120. Briefly, the power bending apparatus 120 includes a frame 122 and a conduit bending shoe, or shoe assembly, 124 which is mounted for rotation upon the frame 122 about a substantially horizontal axis 125 (referred to herein as a first rotation axis 125) and a pressure roller assembly 126 which is supported by the frame 122 beneath the shoe 124. The pressure roller assembly 126 includes a plurality of rollers 128*a*, 128*b* which are horizontally spaced from one another and which are supported for rotation about parallel axes which are each disposed substantially parallel to the first rotation axis 125 about which the shoe 124 is permitted to rotate during a conduit bending operation.

The shoe 124 of the depicted apparatus 120 has a peripheral or arcuate edge 130 which defines a plurality of outwardly-opening grooves 132 which are arranged in a side-by-side relationship and which are each substantially U-shaped in cross section. Moreover, each groove 132 is arranged so that its U-shape opens radially away from the rotation axis 125 of the shoe 124 for closely accepting the outer surface of a conduit 2 desired to be bent by the bending apparatus 120. As used herein, the phrase "closely accepting" is intended to mean that the outwardly-opening groove 132 is fitted about an outer circumference of a conduit 2 in a snug relationship therewith so that the width of the groove opening closely matches the outer diameter of the conduit about which the groove 132 is positioned. In practice—and for conduits having a trade size of 2.5 inches, the width of the outwardly-opening groove 132, when positioned about the outer surface of a conduit, does not exceed the actual outer diameter of the conduit by more than about 0.05 inches.

Meanwhile, the shoe 124 is mounted upon a linkage assembly, generally indicated 134, to permit the shoe 124 to be bodily moved (e.g. manually or hydraulically) relative to the base frame 122 between a lowered position (i.e. a condition of non-use) and a raised position (i.e. a condition of use) at which the spaced-apart rollers 128*a*, 128*b* are disposed beneath and in relatively close proximity to the peripheral edge 130 of the shoe 124.

The apparatus 120 also includes means for forcibly rotating the shoe 124 about the rotation axis 125. Such rotating means can take any of a number of forms, such as manual lever or wheel, or electrically or hydraulically-operated means for providing rotating power to the shoe 124. Moreover, such rotating means can be connected to the shoe 124 by way of any suitable linkage assemblies (not shown) so that manual actuation or actuation of an electric motor or a hydraulic cylinder affects the forced rotation of the shoe 124 about the rotation axis 125. Electrical power, if needed for operation of the apparatus 120, can be supplied by way of a cord capable of being plugged into an electrical outlet or can be supplied by way of a battery pack to render the apparatus 120 cordless. It is noted that the apparatus of the class to which this invention relates is not limited to the apparatus 120 shown and described herein. Other suitable apparatus may also be provided as will be well within the knowledge of one having ordinary skill in the art after becoming familiar with the teachings herein.

The operation of suitable conduit bending apparatus such as the apparatus 120 described herein is well known in the art so that a detailed description of its operation is not believed to be necessary. Suffice it to say that by maintaining pressure downwardly upon the conduit 2 (by way of the shoe 124) and simultaneously rotating the shoe 124 about its rotation axis 125 so that its arcuate edge 130 moves axially, relative to and along the length of the conduit 2, a bend is formed in the conduit 2 which approximates the curvature of that of the arcuate edge 130 of the shoe 124. It will be understood that the rotation axis 125 of the shoe 124 is intended to remain stationary throughout a conduit bending operation while the conduit 2 is pulled endwise beneath the shoe 124 as the downwardly-applied pressure of the shoe 124 maintains the shoe 124 in frictional gripping engagement with the conduit 2.

For a more detailed description of the operation of a known conduit bending apparatus of the class to which the depicted apparatus 120 can be compared (i.e. one which utilizes a conduit bending shoe and spaced-apart rollers across which the conduit to be bent is positioned), reference can be had to the conduit bending apparatus which is shown and described in earlier-referenced U.S. Pat. No. 11,400,503, the disclosure of which is incorporated herein by reference.

As will be apparent herein, the rotational indexing system 10 is used in conjunction with the bending apparatus 120 for, when desired, rotating the conduit 2 about its longitudinal axis 5 through a desired number of angular degrees in preparation for a bend to be formed along the length of the conduit 2 whose plane (in which a bend is to be formed) is angularly offset to a first plane of reference, described herein, by a desired angular amount. For example, if after a first bend is formed along the length of the conduit 2 whose plane (of the first bend) is oriented in a first plane (which provides, in this example, a plane of reference), and a subsequent bend is desired to be formed along the length of the conduit 2 whose plane (of a subsequently-formed bend) is desired to be offset to the plane containing the first-formed bend by forty-five degrees, an operator can, after disengaging the conduit 2 from the shoe 124, utilize the rotational indexing system 10 to rotate, or index, the conduit 2 about its longitudinal axis 5 through any number of degrees (e.g., forty-five degrees) before the shoe 124 is once again re-engaged with the conduit to commence the formation of the next, or subsequent, bend along the length of the conduit 2.

In other words and in this example, the rotational indexing system 10 is well-suited for use in an application in which two successive bends are desired to be formed along the length of a conduit 2, and wherein the planes of the successive bends desired to be formed are not coplanar.

With reference still to FIG. 1, a conduit 2 which is capable of being indexed about its axis 5 with the rotational indexing system 10 of the present invention includes any of the types or styles of cylindrical conduits capable of being bent with the bending apparatus 120. For example, such conduits can be constructed of any of a number of materials, such as steel, stainless steel or aluminum and can be coated with a suitable coating, such as PVC (polyvinyl chloride). Moreover and since the bending apparatus 120 is capable of bending conduit commonly utilized for sheathing electrical wires routed through the center of the conduit, such conduits can include, but are not limited to, EMT (electrical metal tubing), IMC (intermediate metal conduit), RAC (rigid aluminum conduit), stainless steel, and PVC coated conduit.

The conduit indexing system 10 disclosed herein can be implemented with the conduit bending apparatus 120 such as that which has just been described or other suitable conduit bending apparatus now known or later developed. In connection with the foregoing, the conduit indexing system 10 includes means for supporting the distal end of the conduit in a first condition for rotation about a second axis of rotation, indicated as axis 5, and so that the second rotation axis is substantially coincident with the longitudinal axis 5 of the conduit 2. With the distal end 2' of the conduit 2 being supported in such a manner by way of the supporting means in the first condition and subsequently rotatably indexing the supporting means about the second axis of rotation 5 through a desired number of angular degrees to a second condition, the conduit 2 is indexed about its longitudinal axis by a corresponding amount.

Within the depicted conduit indexing system 10, an example supporting means includes a hub assembly 12 including a body 18 about which the distal end 2' of the conduit 2 is positionable. The conduit indexing system 10 includes means, which may be a hub assembly referred to generally as 12, for mounting the distal end 2' of the conduit 2 in a stationary condition with respect to the conduit bending apparatus 120. With the proximal end 2" of the conduit 2 engaged by a correspondingly-sized groove 132 provided in the shoe 124, a first bend can be made in the conduit 2 by way of the conduit bending apparatus 120. Rotating the hub assembly 12 also rotates the conduit 2, such that a plurality of bends may be formed in sequence along the length of a straight conduit 2 wherein the plane in which each subsequent bend is formed along the conduit is disposed in an angular relationship with the plane in which the earlier bend along the conduit 2 is formed.

In an example, one might wish to secure the distal end 2' of a conduit 2 to the hub assembly 12 before the first bend in the conduit 2 is ever made. Otherwise—and upon formation of a first bend, the subsequent disengagement of the proximal end 2' of the conduit 2 from the shoe 124 (for purposes of rotationally indexing the conduit 2 for purposes of forming a second bend) would cause the "original" position (i.e. the frame of reference) of the conduit 2 from which the angular displacement of the conduit 2 is to be measured—is lost. Thus, it may be advantageous to secure the distal end 2' of the conduit 2 to the hub assembly 12 before the first bend in the conduit 2 is made; and if such is the case, there is no need for the hub assembly 12 to be movable toward or away from the shoe 124 for purposes of forming a first bend.

Figure 2:
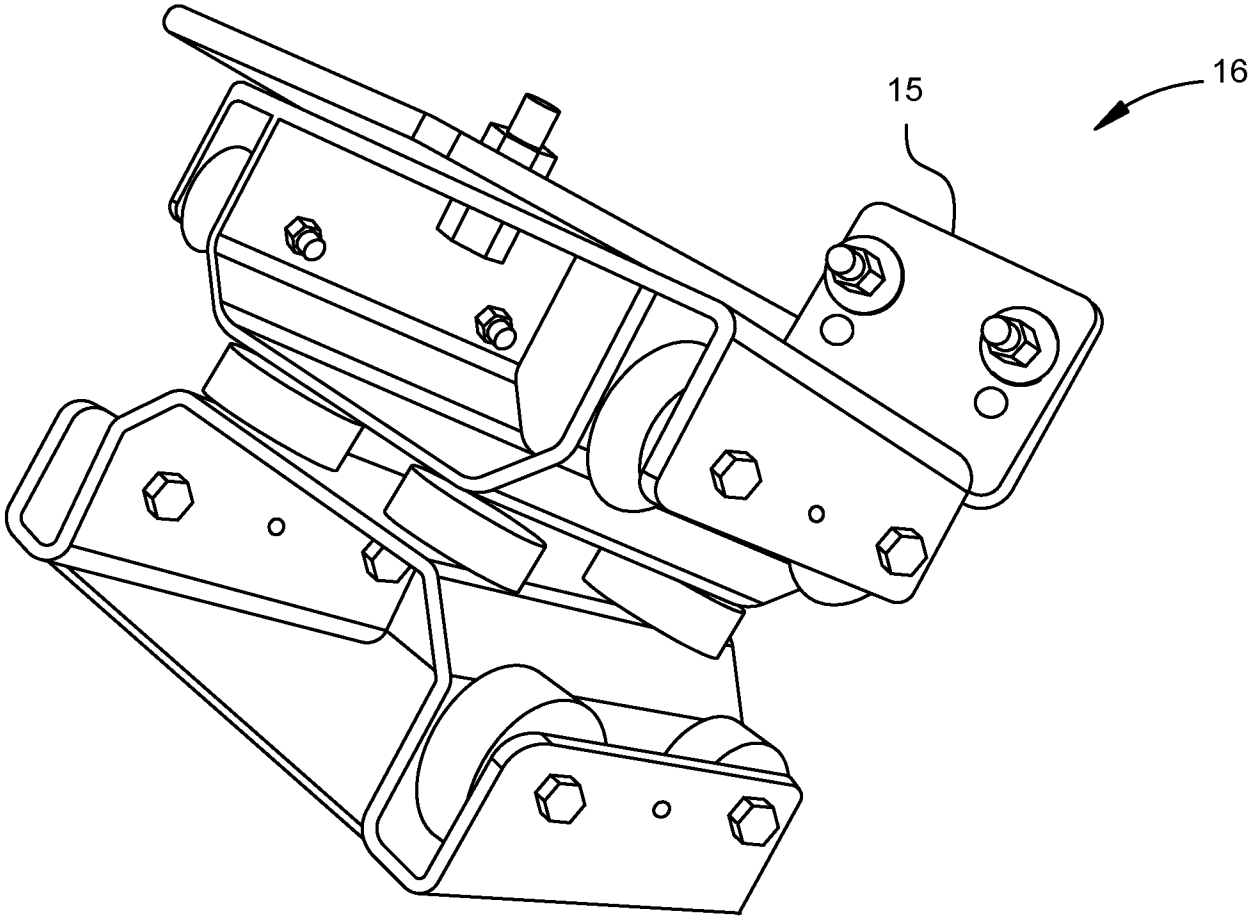
FIG. 2 is a perspective end view of a carriage of the present invention which can be implemented with the rotational indexing system shown in FIG. 1.

In another example, the conduit indexing system 10 also includes means for moving the hub assembly 12. The means for moving the hub assembly 12 may include manually positionable means and/or machine positionable. By way of example, suitable means for moving the hub assembly 12 is shown in FIG. 1 which may include a guide track 14 which extends away from the shoe 124 of the conduit bending apparatus 120, and a multi-wheeled carriage 16 (also seen in FIG. 2) which is mounted upon the guide track 14 for rolling movement relative thereto and along the length thereof toward and away from the shoe 124. The carriage is repositioned along the guide track by manual operation. The carriage 16 may simply be shifted manually along the length of the guide track as the wheels of the wheeled carriage 16 move in rolling engagement along the rails of the guide track 14. The carriage can also be repositioned along the guide track by means of an automated drive such as an electric motor. Still other means for moving the hub assembly 12 are also contemplated and are not limited to the wheeled carriage 16 and guide track 14. Regardless of the means for moving the hub assembly 12, with the conduit 2 mounted to the hub assembly 12 and slidable along the length of the guide track 14 enables the proximal end 2" of the conduit 2 to be positioned at different locations within the shoe 124 for bending the conduit 2 at more than one location.

By way of further illustration, and following making a first bend in the conduit 2 at a first location in the conduit, the carriage 16 may be repositioned on the guide track 14 corresponding to another location in the conduit 2 in which to make another bend. The hub assembly 12 can be rotated, and thus the conduit 2 is rotated a corresponding amount, such that the conduit 2 is readily and accurately indexed about its longitudinal axis 5 in preparation of the formation of a subsequent bend along the length of the conduit 2. The conduit 2 may be indexed through the rotation by the desired number of angular degrees, without the user having to guess or estimate the amount of rotation.

Figure 3:
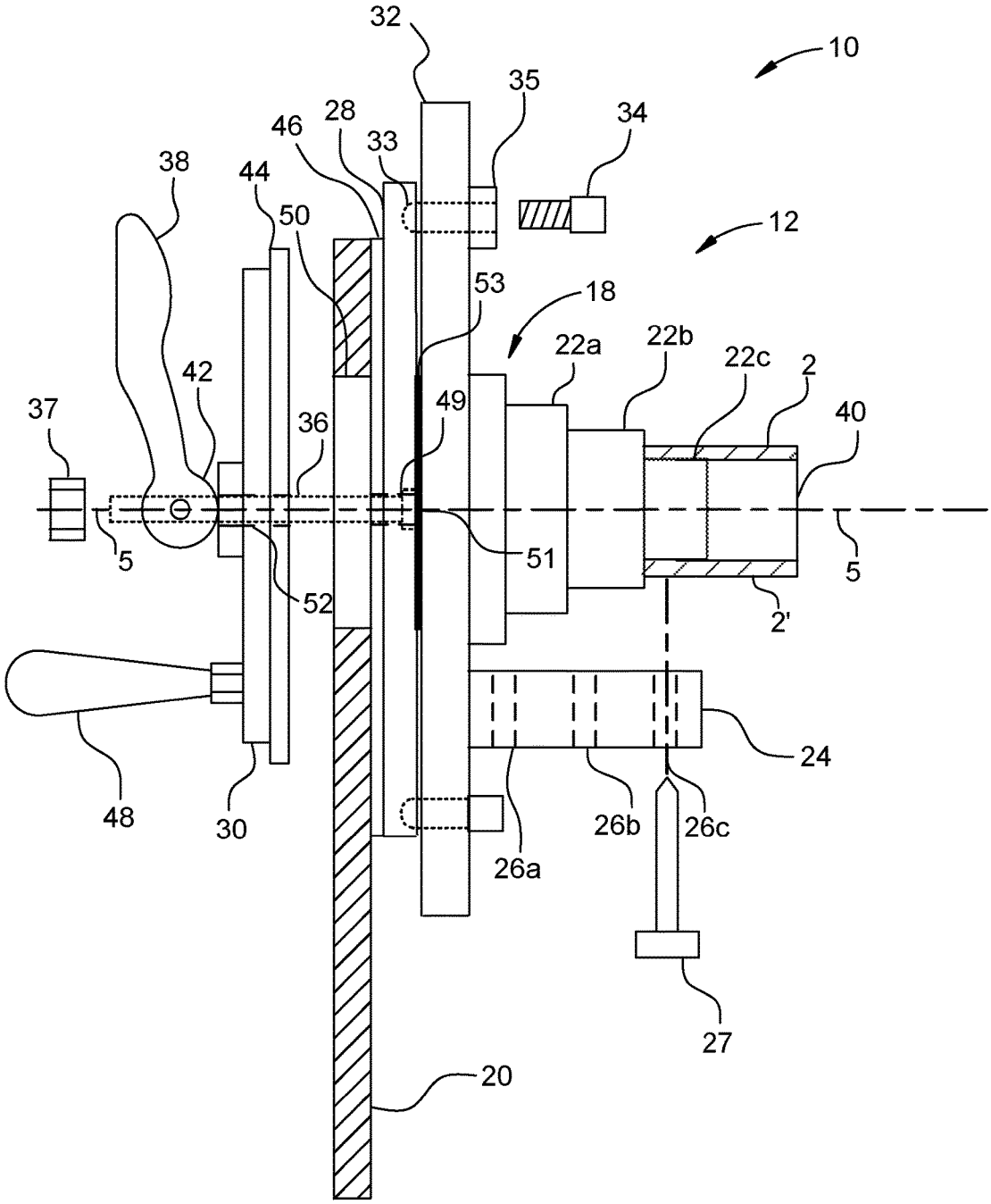
FIG. 3 is a partially exploded side elevation view of the rotational indexing system for the conduit bending apparatus as shown in FIG. 1.

In order for the conduit 2 to be held securely in place for the indexed rotation, the conduit 2 may be secured to the hub assembly 12. The hub assembly 12 is shown in FIGS. 1 and 3 having a body 18 mounted upon a support plate 20 (shown in cross-section in FIG. 3) for rotation relative thereto about an axis of rotation 5 which is oriented substantially normal to the plane of the face thereof. The support plate 20 is supported by the carriage 16 for movement therewith along the length of the guide track 14 and toward and away from the shoe 124. The support plate 20 can be mounted to the carriage 16 by a mounting plate 15. The support plate 20 has a face which is oriented in a plane which is arranged substantially normal to the permitted direction of movement of the carriage 16 along the guide track 14 toward and away from the shoe 2.

The conduit 2 desired to be bent has a longitudinal axis 5, a proximal end 2" which is capable of being engaged by the conduit-bending shoe 124 for conduit-bending purposes and a distal end 2' which extends away from the shoe 124. When utilizing a conduit bending apparatus 120 of the aforedescribed class to form a bend along the length of the conduit 2 after which a first bend is formed therein, the conduit 2 is first removed, or disengaged, from the outwardly-opening groove of the shoe 124, and the conduit 2 is moved relative to (e.g., pulled along beneath) the shoe 124 to advance the conduit to a position beneath the shoe 124 at which the second bend is desired to be formed. However, in order for the plane of the subsequent bend to be formed and angularly offset to the plane of the first-formed bend, the conduit 2 is rotated about its longitudinal axis by the desired angle of offset. For example, if the plane containing a subsequently-formed bend is desired to be offset to the plane containing the first-formed bend by forty-five degrees, the conduit 2 is rotated, or indexed, about its longitudinal axis 5 through forty-five degrees before the shoe 124 is once again moved into engagement with the conduit 2 to commence the formation of the next, or subsequent, bend along the length of the conduit 2.

As seen in FIGS. 1 and 3, means is provided for securing the distal end 2' of the conduit 2 to the body 18 of the hub assembly 12 so that securing the distal end 2' of the conduit 2 to the hub assembly 12 and rotatably indexing the hub assembly 12 about its rotation axis and relative to the face of the support plate 20 through a desired number of angular degrees, also indexes the conduit 2 about its longitudinal axis by a corresponding amount.

The body 18 of the hub assembly 12 has a plurality of cylindrically shaped mounting surfaces 22*a*, 22*b*, 22*c*. Each of the mounting surfaces 22*a*, 22*b*, 22*c* has a different outside diameter relative to each of the other mounting surfaces 22*a*, 22*b*, 22*c*. The outside diameter of the mounting surfaces 22*a*, 22*b*, 22*c* is sized smaller than an inner diameter of the conduit 2 desired to be bent for securing the distal end 2' of the conduit 2 over a corresponding one of the mounting surfaces 22*a*, 22*b*, 22*c* of the hub assembly 12.

A securement arm 24 is mounted on the support plate 20 adjacent to the hub assembly 18. The securement arm 24 has a plurality of threaded openings 26*a*, 26*b*, 26*c* formed therethrough to receive a securement bolt 27. Each of the plurality of threaded openings 26*a*, 26*b*, 26*c* correspond to a different one of the mounting surfaces 22*a*, 22*b*, 22*c*. The securement bolt 27 is tightened against an outer surface of the conduit 2 desired to be bent to secure the conduit 2 against the corresponding mounting surface 22*a*, 22*b*, 22*c* of the hub assembly 12.

As can be seen in FIGS. 3-6, a first compression plate 28 is mounted adjacent to a first face of the support plate 20. A second compression plate 30 is mounted adjacent to a second face of the support plate 20. A first pad 44 can be positioned between the first compression plate 28 and the first face of the support plate 20, and a second pad 46 can be positioned between the second compression plate 30 and the second face of the support plate 20. In an example, a handle 48 is mounted to the first compression plate 28. The handle 48 is operable to move the hub assembly 12 to a desired position in the support plate 20. In an example, the handle 48 may also be connected with the hub assembly to rotate the hub assembly 12 through the desired number of angular degrees so that the conduit 2 is indexed about its longitudinal axis by a corresponding amount.

The first compression plate 28 and the second compression plate 30 are pressed toward each other against the support plate 20 to secure compression plates 28 and 30 to the support plate 20 in a fixed position relative to the support plate 20 for a conduit bending operation.

A lever arm 38 is rotationally mounted to a distal end 40 of an attachment bolt 36. The lever arm 38 has a cam surface 42 configured to press the first compression plate 28 against the first surface of the support plate 20 and draw the first compression plate of the hub assembly 12 and the second compression plate 30 against opposing sides of the support plate 20 as the lever arm 38 is rotated into a closed position, thereby securing the hub assembly 12 on the support plate 20 at a desired position corresponding to the selected shoe 124 of the conduit bending apparatus 120 for the conduit bending operation.

A fastener plate 32 is provided between the hub assembly 12 and the first compression plate 28. The hub assembly 12 is fixedly mounted to the fastener plate 32. The fastener plate 32 in turn is rotatably mounted to the compression plate 28, which in turn has been tightened against the support plate 20 in fixed relation thereto. The fastener plate 32 is rotationally mounted relative to the compression plate 28 via a bearing turntable 53 or other suitable rotational mounting assembly. This arrangement enables the fastener plate 32 to be rotationally indexed about the axis 5 relative to the compression plates 28 and 30 that are fixed relative to the support plate 20. As such, rotating the fastener plate 32 between index locations also rotates the hub assembly 12 and the conduit 2 mounted thereon relative to the fixed position of the support plate 20. At least one plunger 34 is provided through the fastener plate 32 and into one of a plurality of index locations defined by detents, openings (e.g., through holes), or indentations 33 in the first compression plate 28. These indentations 33 in the compression plate 28 are arranged on the face of the compression plate 28 corresponding to different indexing positions (e.g., 10 degree intervals, 30 degree intervals, 45 degree intervals, etc.). Thus plunger 34 can be inserted into the selected indentation 33 in the fastener plate 32 to register the fastener plate 32, and hence the hub assembly 12 and the conduit 2 mounted thereto, to the first compression plate 28 at the desired index location about the axis 5.

With reference to FIGS. 1 and 3, and as seen in more detail in the corresponding perspective views of FIG. 4-11, the hub assembly 12 is mounted upon the support plate 20 for rotation relative thereto about an axis of rotation which is oriented substantially normal to the plane of the face thereof. The body 18 of the hub assembly 12 can be sized to accept various sizes of the distal end 2' of the conduit 2 desired to be bent when the distal end 2' of the conduit 2 is directed endwise thereabout.

Means are provided, as illustrated by way of example in FIGS. 6-11, for securing the distal end 2' of the conduit 2 about the body 18 of the hub assembly 12. Securing the distal end 2' of the conduit 2 about the body 18 of the hub assembly 12 and then rotatably indexing the body 18 of the hub assembly 18 about the second axis of rotation and relative to the face of the support plate 20 through a desired number of angular degrees, also indexes the conduit 2 about its longitudinal axis by a corresponding amount. The means for securing can include a securement bolt 27 having a pointed end to engage with the outer surface of the conduit 2. A securement arm 24 is attached to the support plate 20 and includes a portion positioned adjacent the body 18 of the hub assembly 12. The securement arm 24 defines an internally-threaded opening 26*a*, 26*b*, 26*c* for threadably accepting the securement bolt 27. When the distal end 2' of the conduit 2 desired to be bent is positioned about the body 18 of the hub assembly 12, the securement bolt 27 can be rotated within one of the internally-threaded openings 26*a*, 26*b*, 26*c* of the securement arm 24 to move the end of the securement bolt 27 into engagement with the conduit 2 so that the conduit 2 is tightly held between the cylindrically-shaped section 22*a*, 22*b*, or 22*c* of the body 18 of the hub assembly 12 and the end of the securement bolt 27. Selecting one of the internally-threaded openings 26*a*, 26*b*, 26*c* on the securement arm 24 is based on the position of the conduit 2. For example, if the conduit 2 is mounted to the cylindrically-shaped section 22*a*, then the securement bolt 27 will be provided with the internally-threaded opening 26*a*, if the conduit 2 is mounted to the cylindrically-shaped section 22*b*, then the securement bolt 27 will be provided with the internally-threaded opening 26*b*, and if the conduit 2 is mounted to the cylindrically-shaped section 22*c* (as illustrated in FIG. 3), then the securement bolt 27 will be provided with the internally-threaded opening 26*c*.

The body 18 of the hub assembly 12 can be elongated in shape and has a longitudinal axis which coincides with the rotation axis 5. The cylindrically-shaped sections are arranged along the longitudinal axis of the body 18 of the hub assembly 12. By way of illustration, the body 18 of the hub assembly 12 includes one or more cylindrically-shaped section(s) 22*a*, 22*b*, 22*c* sized to closely accept the distal end 2' of the conduit 2 desired to be bent when the distal end 2' of the conduit 2 is directed endwise thereabout. The cylindrically-shaped section(s) can include a first cylindrically-shaped section 22*a* which is sized to closely accept the distal end of a first size conduit, a second cylindrically-shaped section 22*b* which is sized to closely accept the distal end of a second size conduit and having an outer diameter which is different in magnitude than that of the first cylindrically-shaped section 22*a*, and further having a third cylindrically-shaped section 22*c* which is sized to closely accept the distal end of yet another conduit and having an outer diameter which is different in magnitude than that of the first cylindrically-shaped section 22*a* and the second cylindrically-shaped section 22*b*.

A through-opening 49 is defined in the first compression plate 28 which extends centrally therethrough. The support plate 20 also defines a through-opening 50 (visible in the cross section shown in FIG. 3) which opens out of the face thereof. In an example, the through-opening 50 is slotted to provide for mounting the hub assembly 12 in multiple positions on the support plate 20 (see, e.g., slots 54*a-f* in FIGS. 4-7 and 10-11), as described in more detail below. A fastener 36 has a head that engages with the first compression plate 28 and a shank that extends through the through-opening 49 of the first compression plate 28 and the pad 46, through the through-opening 50 of the support plate 20, and through the through-opening 52 of the second compression plate 30 and pad 44 and handle 38. The fastener 36 is fastened with nut 37. The body 18 of the hub assembly 12 is connected to the fastener plate 32 which is allowed to rotate the body 18 of the hub assembly 12 relative to the support plate 20 to permit the body 18 of the hub assembly 12 to be rotatably indexed relative to the support plate 20 and about the rotation axis as aforesaid.

The body 18 of the hub assembly 12 defines the through-opening 51 which extends centrally therethrough. The support plate 20 defines the through-opening 50 which opens out of the face thereof. A headed fastener 36 has a shank that extends through both the through-opening 51 of the body 18 of the hub assembly 12 and the through-opening 50 (defined by openings 54*a-f* in the support plate 20 as seen in in FIGS. 4-7 and 10-11) to rotatably attach the body 18 of the hub assembly 12 to the support plate 20. The attachment permits the body 18 of the hub assembly 12 to be rotatably indexed relative to the support plate 20 and about the rotation axis as aforesaid.

Figure 4:
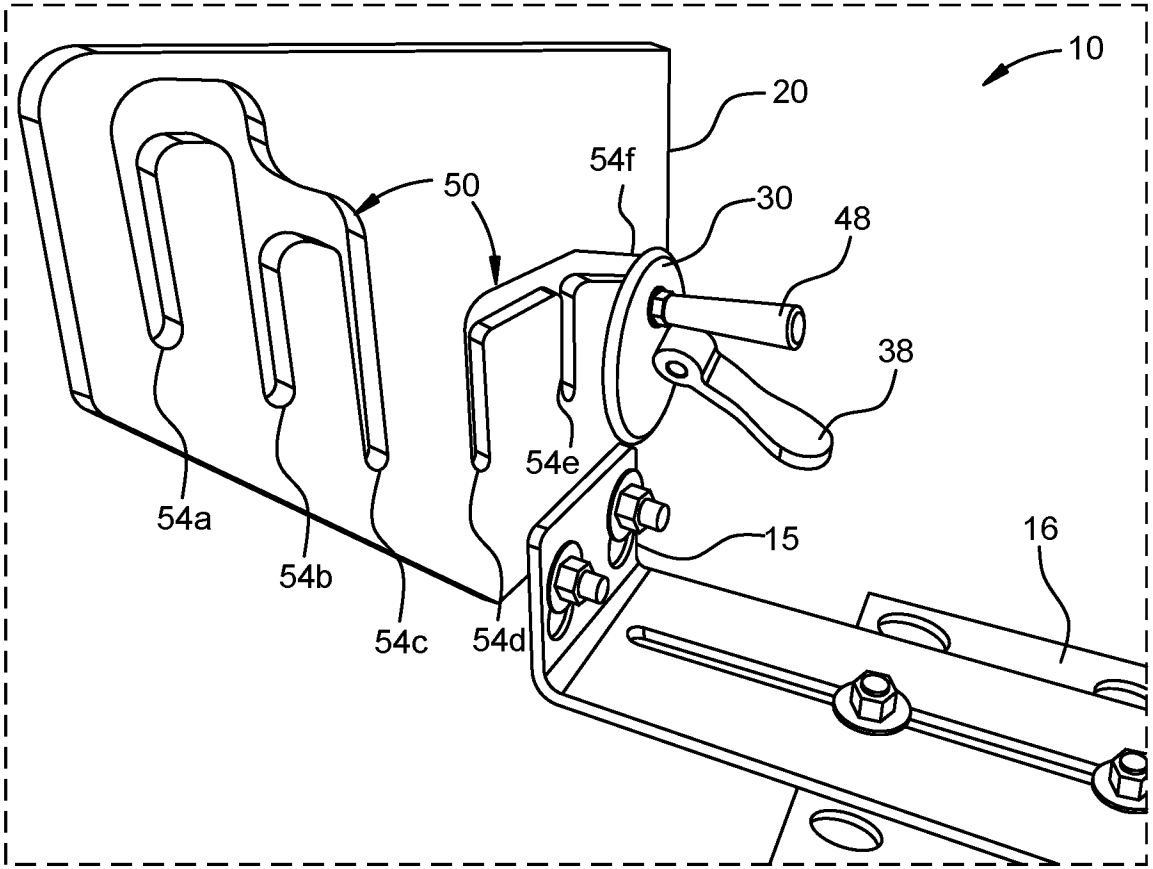
FIG. 4 is a partial perspective view of a support plate and compression plate of the rotational indexing system of the present invention, as seen from the left side in FIG. 3.
Figure 5:
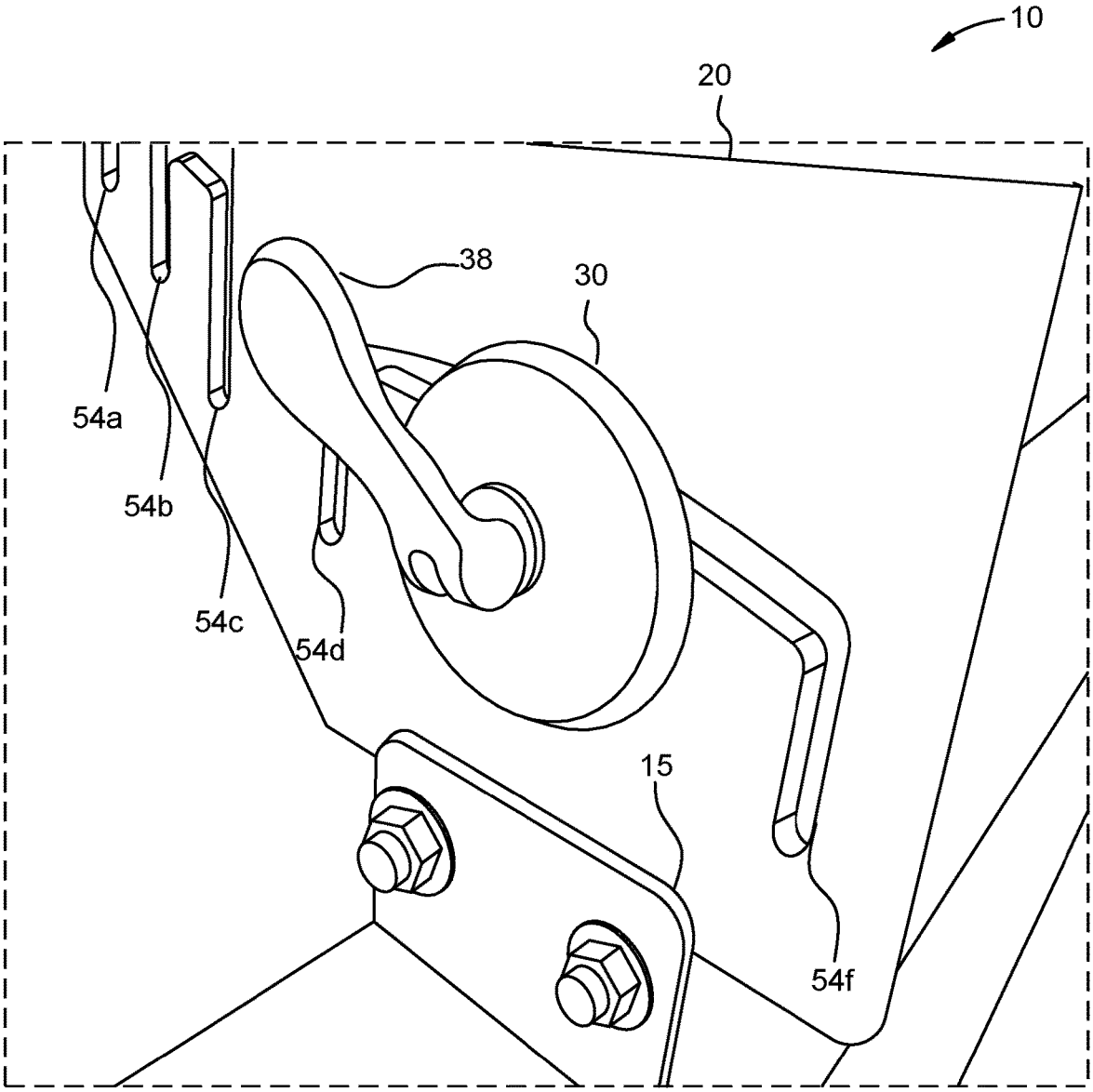
FIG. 5 is a close-up fragment of a perspective view of the support plate and compression plate of the present invention as shown in FIG. 3.
Figure 6:
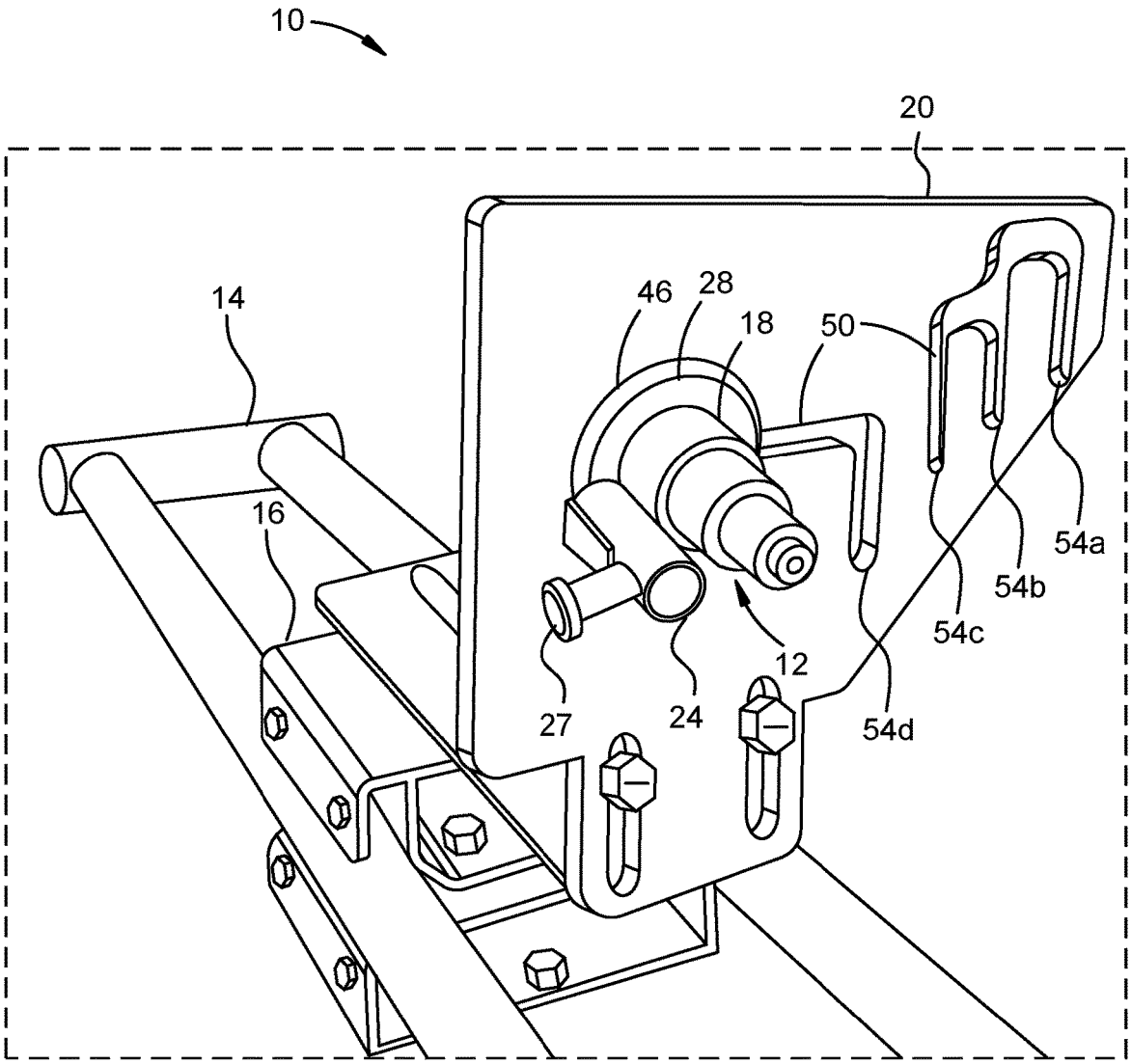
FIG. 6 is a partial perspective view of the support plate and hub assembly of the rotational indexing system of the present invention, as seen from the right side in FIG. 3.
Figure 7:
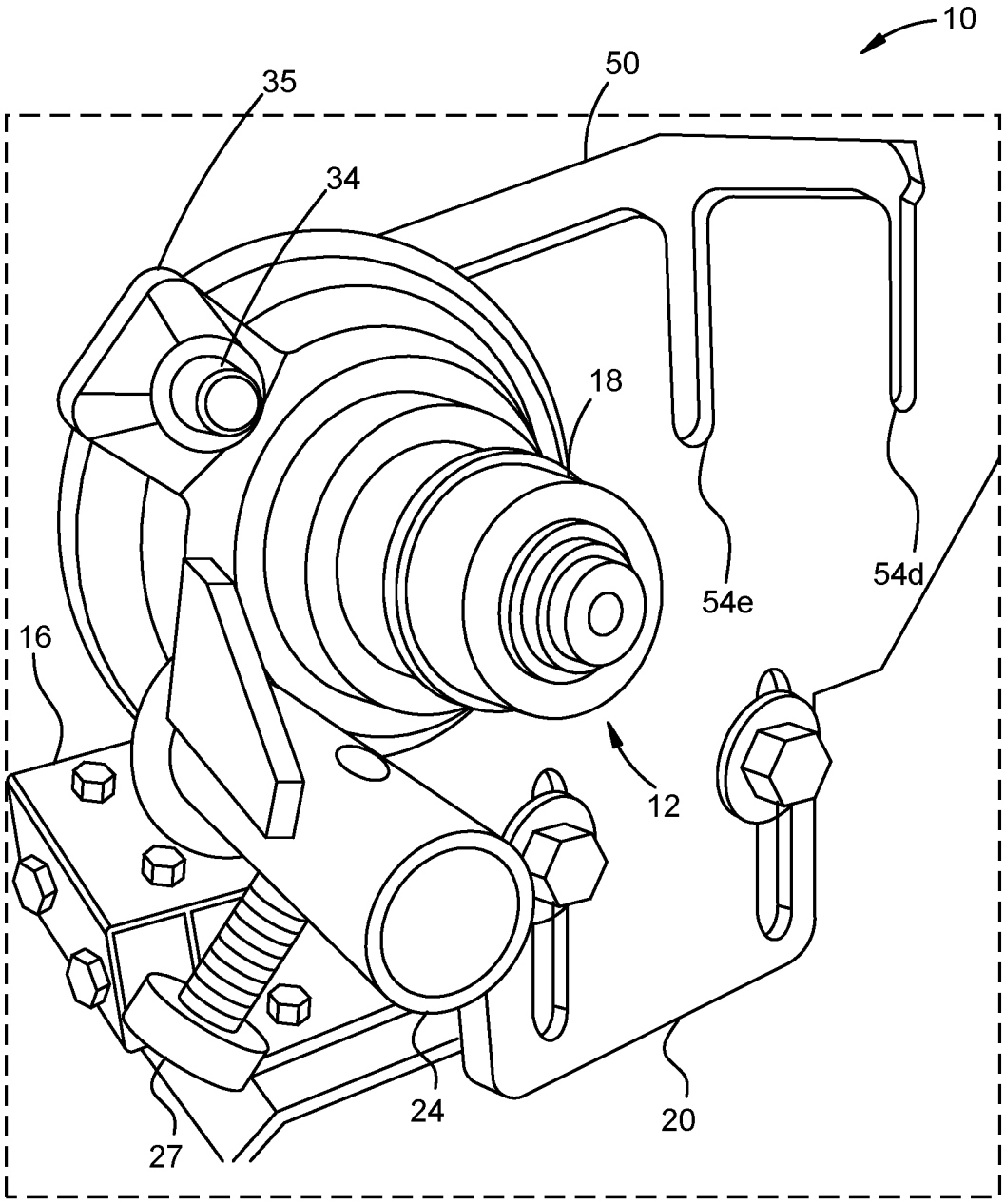
FIGS. 7-11 are close-up fragments of perspective views of the support plate and hub assembly as shown in FIG. 6.
Figure 8:
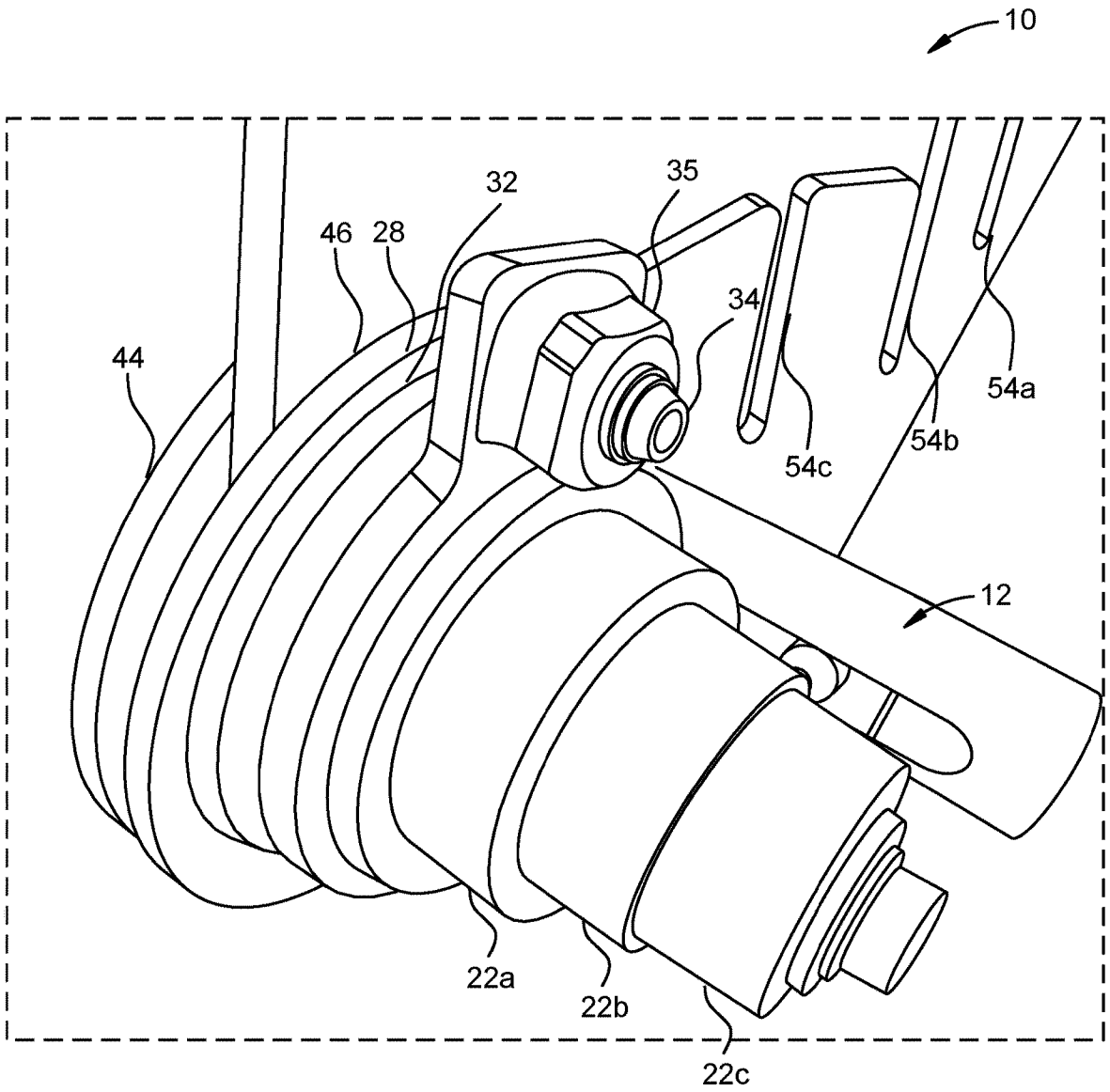
Figure 9:
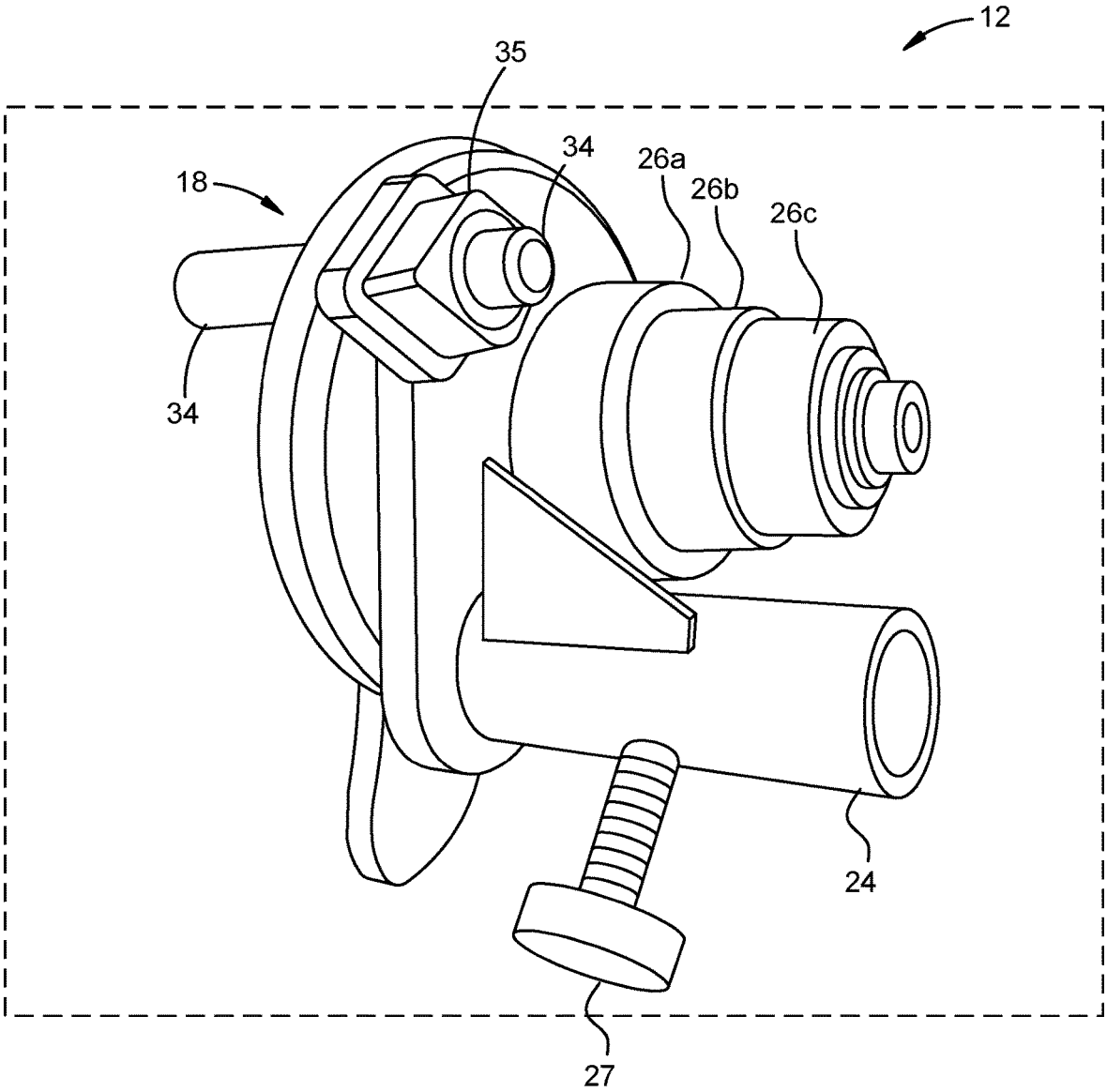

Each of the through-openings 54*a-f* of the support plate 20 is substantially located in an aligned relationship with a corresponding shoe 124 of the plurality of shoes. By way of illustration, the second compression plate 30 is shown in FIG. 4 as it may be positioned in slot 54*f*. The second compression plate 30 is shown in FIG. 5 as it may be repositioned in slot 54*e*. The rotation axis 5 in any of the slots 54*a-f* is substantially aligned with the corresponding shoe 124 of the plurality of shoes by mounting the hub assembly 12 based on a selected one of plurality of through-openings 54*a-f* arranged across the front surface of the support plate 20.

The through-openings 54*a-f* defined in the support plate 20 are connected by through-slots to facilitate the repositioning of the hub member 12 to an alternative one of the plurality of through-openings 54*a-f* as the movement of the shank of the headed fastener 36 is guided by the through-slots 54*a-f*. Means for releasably clamping the hub assembly 12 to the support plate 20 secures the hub assembly 12 to the support plate 20 in a stationary condition relative thereto from which the hub assembly 12 (and conduit 2) can be rotatably indexed about the rotation axis 5.

Figure 10:
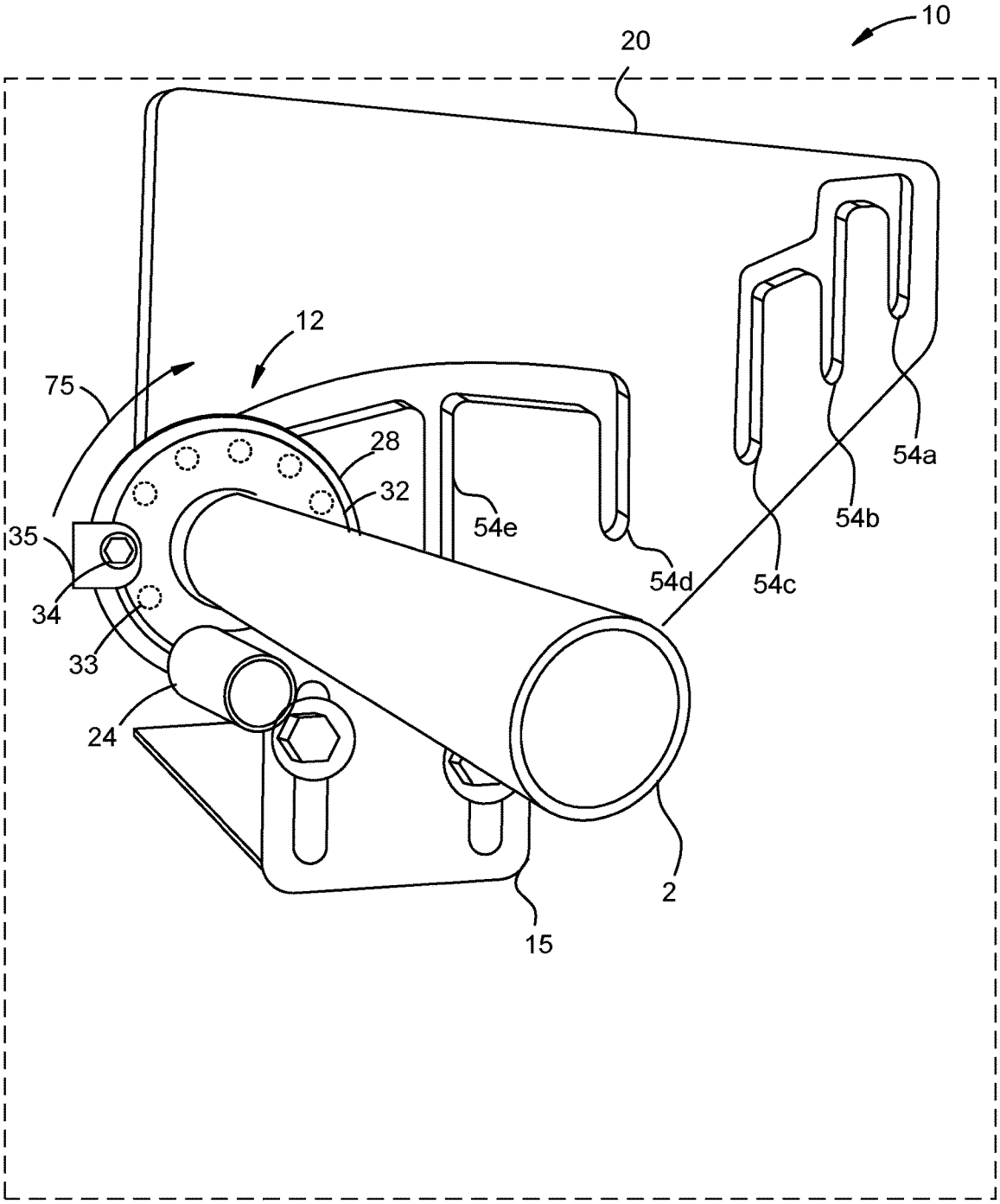

Once the hub assembly 12 is positioned, the body 18 is sized to accept the distal end 2' of the conduit 2 desired to be bent when the distal end 2' of the conduit 2 is directed endwise thereabout. Means is provided for securing the distal end 2' of the conduit 2 about the body 18 of the hub assembly 12. A first bend can be made in the conduit 2, and then a subsequent bend can be made in the conduit 2 by moving the conduit indexing system 10 (e.g., via carriage 16 on rail 14) to the desired location of the second bend to be made in the conduit 2, and rotating the hub assembly 12. In an example, the body 18 of the hub assembly 12 is mounted upon the support plate 20 for indexed rotation relative thereto about the axis of rotation 5 which is oriented substantially normal to the plane of the face thereof. The conduit 2 is indexed about its longitudinal axis 5 by rotatably indexing the body 18 of the hub assembly 12 about the axis of rotation 5 and relative to the face of the support plate 20. Rotation through a desired number of angular degrees indexes the conduit about its longitudinal axis by a corresponding amount as described below. Rotation may be through any angular interval, such as but not limited to, 30 degrees, 45 degrees, 60 degrees, 90 degrees, etc. relative to the first bend. For example, the conduit 2 is shown in FIG. 10 as it may be rotated as illustrated by arrow 74 from a first position shown in FIG. 10 (corresponding to the position of plunger 34), to a second position shown in FIG. 11 (corresponding to the position of plunger 34) which is about a 90 degree angular interval.

In an example, a registration mechanism, which can include a plunger 34, registers the fastener plate 32 with the first compression plate 28 of the body 18 of the hub assembly 12. Any suitable plunger 34 may be provided. In FIG. 3, the plunger is shown as being a threaded plunger 34 which threads into nut 35 attached (e.g., by welding) to the fastener plate 32. However, the plunger may also be spring-biased, a pin with cotter pin, etc. so long as the plunger 34 registers the fastener plate 32 with the first compression plate 28 for example by being accepted into indentation 33 in the first compression plate 28.

Figure 11:
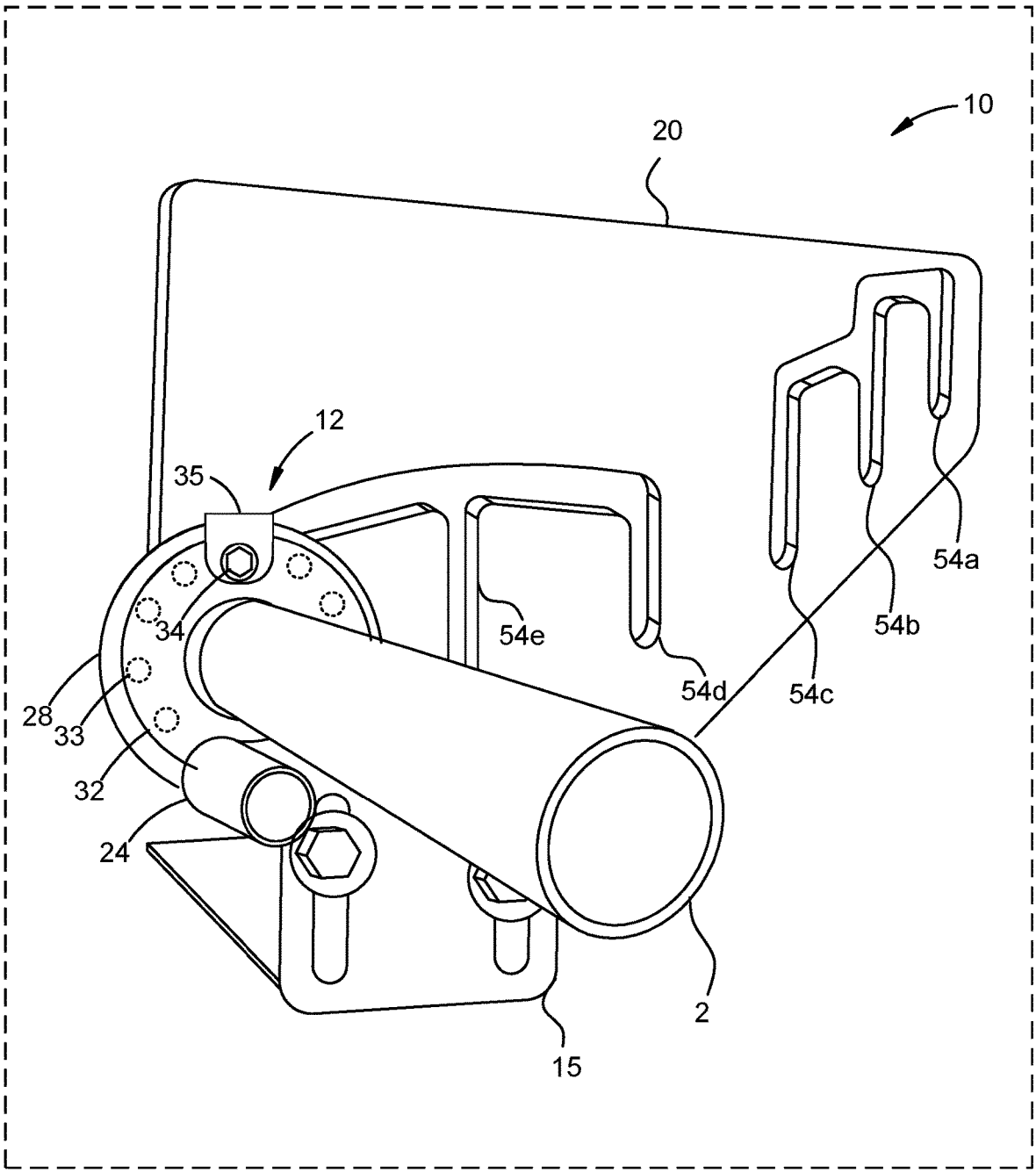

The plunger 34 in the fastener plate 32 is positionable in registry with any one of a plurality of indentations 33 arranged along a circular path in the first compression plate 28 as the body 18 of the hub assembly 12. It is noted that an indentation 33 is visible in FIG. 3, and a pattern or arrangement of a plurality of indentations 33 are seen in FIGS. 10 and 11, shown in dashed lines as these are not visible in the view shown in FIGS. 10 and 11 as the indentations 33 are formed in the compression plate 28 behind the fastener plate 32. The plunger 34 can be released for rotation of the body 18 of the hub assembly 12 relative to the face of the support plate 20 about axis 5 so that the conduit 2 secured to the hub assembly 12 is rotatably indexed relative to the support plate 20 and about the axis of rotation 5. The plunger 34 is capable of being accepted by any one of the plurality of indentations 33 arranged in the compression plate 28 when the plunger 34 is positioned in registry with one of the indentations 33 so that the body 18 of the hub assembly 12 is rotatably indexed relative to the support plate 20 as aforesaid until the spring-biased plunger 34 is positioned in registry with one of the indentations 33 arranged along said path. The plunger 34 is accepted by the one indentation 33 and thereby releasably secures the hub assembly 12 in a stationary relationship relative to the support plate 20. The indentations 33 can be spaced apart from one another at predetermined angular intervals to facilitate the rotational indexing of the body 18 of the hub assembly 12 about the rotation axis 5. Any number of suitable angular intervals may be provided as indentations 33, such as but not limited to, 30 degrees, 45 degrees, 60 degrees, 90 degrees, etc.

It will be understood that numerous modifications and substitutions can be had to the aforedescribed embodiment 10 without departing from the spirit of the invention. Accordingly, the aforedescribed embodiments are intended for the purpose of illustration and not as limitation.

The invention claimed is:

1. A conduit indexing system for use with a conduit bending apparatus having a conduit-bending shoe mounted for rotation about a first axis and wherein the conduit desired to be bent has a longitudinal axis, a proximal end which is capable of being engaged by the conduit-bending shoe for conduit-bending purposes and a distal end which extends away from the shoe, the conduit indexing system comprising:

a guide track having a length and which extends lengthways away from the shoe of the conduit bending apparatus;

a carriage which is mounted upon the guide track for movement relative thereto and along the length thereof toward and away from the shoe;

a support plate supported by the carriage for movement therewith along the length of the guide track, and the support plate having a face which is oriented in a plane which is arranged substantially normal to the permitted direction of movement of the carriage along the guide track;

a hub assembly having a body which is mounted upon the support plate for rotation relative thereto about a second axis of rotation which is oriented substantially normal to the plane of the face thereof and wherein the body is sized to accept the distal end of the conduit desired to be bent; and means for securing the distal end of the conduit about the body of the hub assembly so that by securing the distal end of the conduit about the body of the hub assembly and then rotatably indexing the body of the hub assembly about the second axis of rotation and relative to the face of the support plate through a desired number of angular degrees, the conduit is indexed about its longitudinal axis by a corresponding amount;

wherein the body of the hub assembly defines a through-opening which extends centrally therethrough, the support plate defines a through-opening which opens out of the face thereof, and the system further includes a headed fastener having a shank which extends through both the through-opening of the body of the hub assembly and the through-opening of the support plate to rotatably attach the body of the hub assembly to the support plate to permit the body of the hub assembly to be rotatably indexed relative to the support plate and about the second rotation axis as aforesaid.

2. A conduit rotational indexing system for use with a conduit bending apparatus having a plurality of conduit-bending shoes mounted in a side-by-side relationship for rotation about a first axis and wherein the conduit desired to be bent has a longitudinal axis, a proximal end which is capable of being engaged by one of the conduit-bending shoes for conduit-bending purposes and a distal end which extends away from the one shoe, the conduit indexing system comprising:

a guide track having a length and which extends lengthways away from the one shoe of the conduit bending apparatus;

a carriage which is mounted upon the guide track for movement relative thereto and along the length thereof toward and away from the one shoe;

a support plate supported by the carriage for movement therewith along the length of the guide track and toward and away from the one shoe, and the support plate having a face which is oriented in a plane which is arranged substantially at 90 degrees to the permitted direction of movement of the carriage along the guide track and toward and away from the one shoe;

a hub assembly having a body which is mounted upon the support plate for rotation relative thereto about a second axis of rotation which is oriented substantially normal to the plane of the face thereof and wherein the body is sized to accept the distal end of the conduit desired to be bent; and means for securing the distal end of the conduit about the body of the hub assembly so that by securing the distal end of the conduit about the body of the hub assembly and then rotatably indexing the body of the hub assembly about the second axis of rotation and relative to the face of the support plate through a desired number of angular degrees, the conduit is indexed about its longitudinal axis by a corresponding amount;

wherein the body of the hub assembly defines a through-opening which extends centrally therethrough, the support plate defines a through-opening which opens out of the face thereof, and the system further includes a headed fastener whose shank extends through both the through-opening of the body of the hub assembly and the through-opening of the support plate to rotatably attach the body of the hub assembly to the support plate to permit the body of the hub assembly to be rotatably indexed relative to the support plate and about the second rotation axis as aforesaid.

3. The system as defined in claim 2 further comprising a secondary plate mounted upon the carriage and which is arranged adjacent the support plate and substantially parallel thereto, and the secondary plate includes a front surface and defines a plurality of through-openings disposed across the front surface thereof wherein each of the through-openings of the secondary plate is substantially located in an aligned relationship with a corresponding shoe of the plurality of shoes so that by mounting the hub assembly to a selected one of the plurality of through-openings arranged across the front surface of the secondary plate by way of the headed fastener, the second rotation axis is substantially aligned with the corresponding shoe of the plurality of shoes.

4. The system as defined in claim 3 wherein the through-openings defined in the secondary plate are connected by through-slots to facilitate the repositioning of the hub assembly to an alternative one of the plurality of through-openings as the movement of the shank of the headed fastener is guided by the through-slots.

5. The system as defined in claim 4 further comprising means for releasably clamping the secondary plate to the support plate to thereby secure the support plate in a stationary condition about the second rotation axis and from which the hub assembly can be rotatably indexed about the second rotation axis.

6. A conduit indexing system for use with a conduit bending apparatus having a conduit-bending shoe mounted for rotation about a first axis and wherein the conduit desired to be bent has a longitudinal axis, a proximal end which is capable of being engaged by the conduit-bending shoe for conduit-bending purposes and a distal end which extends away from the shoe, the conduit indexing system comprising:

a guide track having a length and which extends lengthways away from the shoe of the conduit bending apparatus;

a carriage which is mounted upon the guide track for movement relative thereto and along the length thereof toward and away from the shoe;

a support plate supported by the carriage for movement therewith along the length of the guide track and toward and away from the shoe;

a hub assembly having a body which is mounted upon the support plate for rotation relative thereto about a second axis of rotation which is arranged substantially parallel to the permitted direction of movement of the carriage along the guide track and toward and away from the shoe and wherein the body is sized to accept the distal end of the conduit desired to be bent;

means for securing the support plate in a stationary position relative to the second rotation axis; and means for securing the distal end of the conduit about the body of the hub assembly so that by securing the support plate in a stationary position relative to the second rotation axis, securing the distal end of the conduit about the body of the hub assembly and then rotatably indexing the body of the hub assembly about the second axis of rotation and relative to the support plate through a desired number of angular degrees, the conduit is indexed about its longitudinal axis by a corresponding amount;

wherein the body of the hub assembly includes a cylindrically-shaped section which is centered about the second rotation axis and which is sized to accept the distal end of the conduit desired to be bent when the distal end of the conduit is directed endwise about the cylindrically-shaped section;

wherein the cylindrically-shaped section is a first cylindrically-shaped section and the body of the hub assembly includes a second cylindrically-shaped section which is centered about the second rotation axis and is sized to accept the distal end of an alternative conduit desired to be bent with the conduit bending apparatus.

7. A conduit indexing system for use with a conduit bending apparatus having a conduit bending shoe mounted for rotation about a first axis and wherein a conduit to be bent with the apparatus has a longitudinal axis about which the conduit is desired to be indexed with the conduit indexing system, a proximal end capable of being engaged by the conduit bending shoe for conduit bending purposes, and a distal end which extends away from the conduit bending shoe, the conduit indexing system comprising:

a hub assembly for supporting the distal end of the conduit in a first condition for rotation about a second axis of rotation and so that the second rotation axis is substantially coincident with the longitudinal axis of the conduit so that by supporting the distal end of the conduit by way of the hub assembly in the first condition and subsequently rotatably indexing the hub assembly about the second axis of rotation through a desired number of angular degrees to a second condition, the conduit is indexed about its longitudinal axis by a corresponding amount;

a support plate which is associated with the hub assembly and defines a planar face which is arranged substantially normal to the longitudinal axis of the conduit so that by rotatably indexing the body of the hub assembly about the second axis of rotation through a desired number of angular degrees while the distal end of the conduit is supported by the hub assembly effects the indexing of the conduit about its longitudinal axis and relative to the planar face of the support plate through the desired number of angular degrees; and wherein the planar face of the support plate bears indicia-providing means which identifies for an operator the amount of angular degrees about the second rotation axis through which the body of the hub assembly is rotatably indexed from the first condition.

8. The system as defined in claim 7 further comprising means for supporting the hub assembly for movement toward and away from the conduit bending shoe to permit the conduit having a length within a relatively broad range of lengths to be supported by the hub assembly as the conduit extends from the conduit bending apparatus.

9. The system as defined in claim 7 wherein the hub assembly includes a body which is mounted upon the support plate for rotation relative thereto about the second rotation axis and which is adapted to be connected to the distal end of the conduit for maintaining the distal end of the conduit in the first condition.

10. A conduit indexing system for use with a conduit bending apparatus having a conduit-bending shoe mounted for rotation about a first axis and wherein the conduit desired to be bent has a longitudinal axis, a proximal end which is capable of being engaged by the conduit-bending shoe for conduit-bending purposes and a distal end which extends away from the shoe, the conduit indexing system comprising:

a guide track having a length and which extends lengthways away from the shoe of the conduit bending apparatus;

a carriage which is mounted upon the guide track for movement relative thereto and along the length thereof toward and away from the shoe;

a support plate supported by the carriage for movement therewith along the length of the guide track, and the support plate having a face which is oriented in a plane which is arranged substantially normal to the permitted direction of movement of the carriage along the guide track;

a hub assembly having a body which is mounted upon the support plate for rotation relative thereto about a second axis of rotation which is oriented substantially normal to the plane of the face thereof and wherein the body is sized to accept the distal end of the conduit desired to be bent; and means for securing the distal end of the conduit about the body of the hub assembly so that by securing the distal end of the conduit about the body of the hub assembly and then rotatably indexing the body of the hub assembly about the second axis of rotation and relative to the face of the support plate through a desired number of angular degrees, the conduit is indexed about its longitudinal axis by a corresponding amount;

wherein the body of the hub assembly includes a cylindrically-shaped section which is sized to closely accept the distal end of the conduit desired to be bent;

wherein the means for securing includes a securement bolt having an end and further includes a securement arm which is attached to the support plate and includes a portion positioned adjacent the body of the hub assembly, and the securement arm defines an internally-threaded opening for threadably accepting the securement bolt so that when the distal end of the conduit desired to be bent is positioned about the body of the hub assembly, the securement bolt can be rotated within the internally-threaded opening of the securement arm to move the end of the securement bolt into engagement with the conduit so that the conduit is tightly held between the cylindrically-shaped section of the body of the hub assembly and the end of the securement bolt.

11. A conduit indexing system for use with a conduit bending apparatus having a conduit-bending shoe mounted for rotation about a first axis and wherein the conduit desired to be bent has a longitudinal axis, a proximal end which is capable of being engaged by the conduit-bending shoe for conduit-bending purposes and a distal end which extends away from the shoe, the conduit indexing system comprising:

a guide track having a length and which extends lengthways away from the shoe of the conduit bending apparatus;

a carriage which is mounted upon the guide track for movement relative thereto and along the length thereof toward and away from the shoe;

a support plate supported by the carriage for movement therewith along the length of the guide track, and the support plate having a face which is oriented in a plane which is arranged substantially normal to the permitted direction of movement of the carriage along the guide track;

a hub assembly having a body which is mounted upon the support plate for rotation relative thereto about a second axis of rotation which is oriented substantially normal to the plane of the face thereof and wherein the body is sized to accept the distal end of the conduit desired to be bent; and means for securing the distal end of the conduit about the body of the hub assembly so that by securing the distal end of the conduit about the body of the hub assembly and then rotatably indexing the body of the hub assembly about the second axis of rotation and relative to the face of the support plate through a desired number of angular degrees, the conduit is indexed about its longitudinal axis by a corresponding amount;

wherein the body of the hub assembly includes a cylindrically-shaped section which is sized to closely accept the distal end of the conduit desired to be bent;

wherein the cylindrically-shaped section is a first cylindrically-shaped section, and the body of the hub assembly includes a second cylindrically-shaped section which is sized to closely accept the distal end of a second conduit having an inner diameter which is different in magnitude than that of the conduit desired to be bent.

12. The system as defined in claim 11 wherein the body of the hub assembly is elongated in shape and has a longitudinal axis which coincides with the second rotation axis, and the first and second cylindrically-shaped sections are arranged along the longitudinal axis of the body of the hub assembly.

13. A conduit indexing system for use with a conduit bending apparatus having a conduit-bending shoe mounted for rotation about a first axis and wherein the conduit desired to be bent has a longitudinal axis, a proximal end which is capable of being engaged by the conduit-bending shoe for conduit-bending purposes and a distal end which extends away from the shoe, the conduit indexing system comprising:

a guide track having a length and which extends lengthways away from the shoe of the conduit bending apparatus;

a carriage which is mounted upon the guide track for movement relative thereto and along the length thereof toward and away from the shoe;

a support plate supported by the carriage for movement therewith along the length of the guide track, and the support plate having a face which is oriented in a plane which is arranged substantially normal to the permitted direction of movement of the carriage along the guide track;

a hub assembly having a body which is mounted upon the support plate for rotation relative thereto about a second axis of rotation which is oriented substantially normal to the plane of the face thereof and wherein the body is sized to accept the distal end of the conduit desired to be bent;

means for securing the distal end of the conduit about the body of the hub assembly so that by securing the distal end of the conduit about the body of the hub assembly and then rotatably indexing the body of the hub assembly about the second axis of rotation and relative to the face of the support plate through a desired number of angular degrees, the conduit is indexed about its longitudinal axis by a corresponding amount; and means associated with the support plate for releasably securing the body of the hub assembly in a stationary relationship with respect to the support plate upon rotatably indexing the body of the hub assembly about the second axis of rotation through a desired number of angular degrees.

14. The system as defined in claim 13 further comprising a compression plate having a series of indentations arranged along a path which extends across the face of the compression plate, said path is spaced apart from the second rotation axis; and the means associated with the support plate includes a spring-biased plunger which is mounted within the body of the hub assembly for movement along the face of the support plate and is positionable in registry with any one of the indentations arranged along said path as the body of the hub assembly is rotatably indexed relative to the support plate and about the second axis of rotation and which is capable of being accepted by any one of the indentations arranged along said path when the spring-biased plunger is positioned in registry with the indentation so that by rotatably indexing the body of the hub assembly relative to the support plate as aforesaid until the spring-biased plunger is positioned in registry with one of the indentations arranged along said path, the plunger is accepted by the one indentation and thereby releasably secures the hub assembly in a stationary relationship relative to the support plate.

15. The system as defined in claim 14 wherein the indentations are spaced from one another at predetermined angular intervals to facilitate the rotational indexing of the body of the hub assembly about the second rotation axis.

16. A conduit indexing system for use with a conduit bending apparatus having a conduit-bending shoe mounted for rotation about a first axis and wherein the conduit desired to be bent has a longitudinal axis, a proximal end which is capable of being engaged by the conduit-bending shoe for conduit-bending purposes and a distal end which extends away from the shoe, the conduit indexing system comprising:

a guide track having a length and which extends lengthways away from the shoe of the conduit bending apparatus;

a carriage which is mounted upon the guide track for movement relative thereto and along the length thereof toward and away from the shoe;

a support plate supported by the carriage for movement therewith along the length of the guide track and toward and away from the shoe;

a hub assembly having a body which is mounted upon the support plate for rotation relative thereto about a second axis of rotation which is arranged substantially parallel to the permitted direction of movement of the carriage along the guide track and toward and away from the shoe and wherein the body is sized to accept the distal end of the conduit desired to be bent;

means for securing the support plate in a stationary position relative to the second rotation axis; and means for securing the distal end of the conduit about the body of the hub assembly so that by securing the support plate in a stationary position relative to the second rotation axis, securing the distal end of the conduit about the body of the hub assembly and then rotatably indexing the body of the hub assembly about the second axis of rotation and relative to the support plate through a desired number of angular degrees, the conduit is indexed about its longitudinal axis by a corresponding amount; and a securement bolt having an end; and a securement arm which is attached to the support plate and includes a portion positioned adjacent the body of the hub assembly, and the securement arm defines an internally-threaded opening for threadably accepting the securement bolt so that when the distal end of the conduit desired to be bent is positioned about the body of the hub assembly, the securement bolt can be rotated within the internally-threaded opening of the securement arm to move the end of the securement bolt into engagement with the conduit so that the conduit is tightly held between the cylindrically-shaped section of the body of the hub assembly and the end of the securement bolt.

* * * * *